US009901971B2

(12) United States Patent
Kelsch et al.

(10) Patent No.: US 9,901,971 B2
(45) Date of Patent: Feb. 27, 2018

(54) FORMING TOOL FOR THE PRODUCTION OF A SEMIFINISHED PRODUCT OR END PRODUCT

(71) Applicant: voestalpine Metal Forming GmbH, Krems an der Donau (AT)

(72) Inventors: Reiner Kelsch, Mutlangen (DE); Robert Schneider, Stimpfach (DE)

(73) Assignee: voestalpine Metal Forming GmbH, Krems an der Donau (AT)

( * ) Notice: Subject to any disclaimer, the term of this patent is extended or adjusted under 35 U.S.C. 154(b) by 0 days.

(21) Appl. No.: 15/094,310

(22) Filed: Apr. 8, 2016

(65) Prior Publication Data

US 2016/0296991 A1 Oct. 13, 2016

(30) Foreign Application Priority Data

Apr. 10, 2015 (EP) ..... 15163279

(51) Int. Cl.

| | |
|---|---|
| ***B21D 22/02*** | (2006.01) |
| ***B21D 37/14*** | (2006.01) |
| ***B21D 22/20*** | (2006.01) |
| ***B21D 37/16*** | (2006.01) |

(52) U.S. Cl.

CPC ..... *B21D 37/14* (2013.01); *B21D 22/022* (2013.01); *B21D 22/208* (2013.01); *B21D 37/16* (2013.01)

(58) Field of Classification Search

CPC ..... B21D 22/022; B21D 37/14; B21D 37/16; B21D 22/208

See application file for complete search history.

(56) References Cited

U.S. PATENT DOCUMENTS

2014/0260493 A1 9/2014 Yoon

FOREIGN PATENT DOCUMENTS

| | | | |
|---|---|---|---|
| EP | 1 645 345 A2 | 4/2006 | |
| EP | 1 970 136 A1 | 9/2008 | |
| EP | 2 548 670 A1 | 1/2013 | |
| EP | 2548670 A1 * | 1/2013 | ..... B21D 22/022 |

OTHER PUBLICATIONS

Machine translation of EP 2548670 A1, Muellers et al., dated Jan. 5, 2017, pp. 1-13.*

* cited by examiner

*Primary Examiner* — Teresa M Ekiert
(74) *Attorney, Agent, or Firm* — Collard & Roe, P.C.

(57) ABSTRACT

A forming tool (1) for the production of a semifinished product or end product from a metal sheet (2) has a first tool part (3) that has an upper tool part (5), a die (6), and at least one first floating bearing (7), which attaches the die (6) to the upper tool part (5) with bearing play (18) in the bearing plane (33), for equalization of its thermal contraction or expansion, has a second tool part (4) that has a lower tool part (9), a punch (8), and at least one second floating bearing (11), which attaches the punch (8) to the lower tool part (9) with bearing play (32) in the bearing plane (34), for equalization of its thermal contraction or expansion, wherein punch (8) and die (6) work together for forming of the metal sheet (2). The two tool parts (3, 4) each have at least one further bearing (12, 13), which bearings attach die (6) and punch (8) to the upper tool part (5) or lower tool part (9) without play in the bearing plane (33, 34).

18 Claims, 3 Drawing Sheets

FORMING TOOL FOR THE PRODUCTION OF A SEMIFINISHED PRODUCT OR END PRODUCT

CROSS REFERENCE TO RELATED APPLICATIONS

Figure 1:
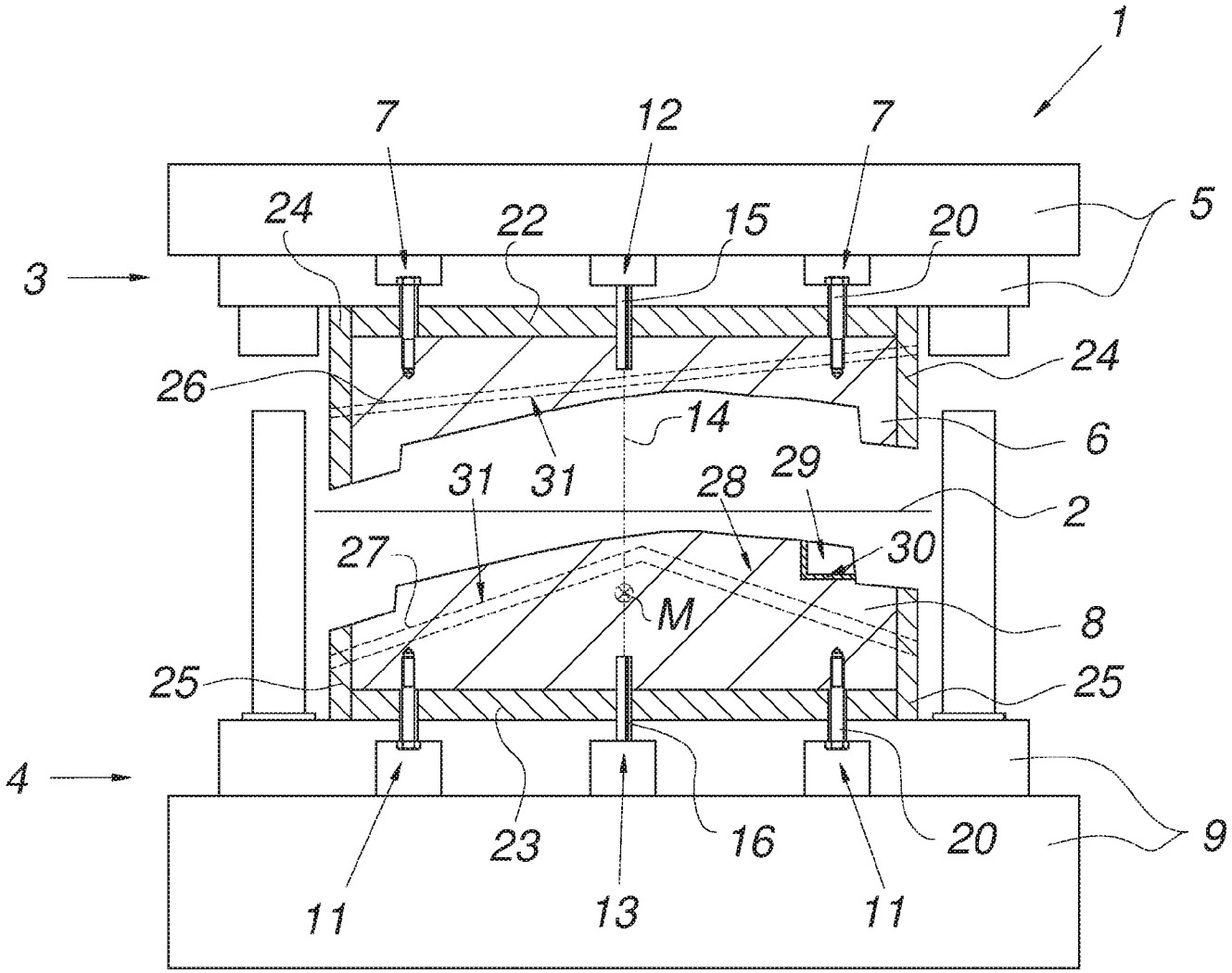

Applicant claims priority under 35 U.S.C. § 119 of European Application No. 15163279.1 filed on Apr. 10, 2015, the disclosure of which is incorporated by reference.

The invention relates to a forming tool for the production of a semifinished product or end product from a metal sheet, having a first tool part that has an upper tool part, a die, and at least one first floating bearing, which attaches the die to the upper tool part with bearing play in the bearing plane, for equalization of its thermal contraction or expansion, having a second tool part that has a lower tool part, a punch, and at least one second floating bearing, which attaches the punch to the lower tool part with bearing play in the bearing plane, for equalization of its thermal contraction or expansion, wherein punch and die work together for forming of the metal sheet.

In order to be able to absorb heat expansions in a forming tool, EP2548670A1 proposes mounting its heated die as well as its heated punch on the upper tool part or lower tool part, respectively, by way of four floating bearings disposed in cross shape, in each instance. As floating bearings, sliding blocks guided in oblong holes are proposed, which have a bearing play in the bearing plane, in order to be able to equalize lateral thermal contraction or expansion of die and punch. However, floating mounting of die and punch can lead to imprecisions in their relative orientation and thereby endanger the shape precision of the formed sheet metal. In order to avoid this, EP2548670A1 provides for a centering guide between die and punch—but this is relatively complicated in terms of design, particularly since this centering guide might have to absorb great mechanical forces in order to be able to equalize a thermal offset of die and punch.

The invention has therefore set itself the task of simplifying a forming tool of the type described initially, in terms of design, but nevertheless being able to ensure the greatest possible shape precision of the formed metal sheet, robust with regard to thermal expansion or contraction.

The invention accomplishes the stated task in that the two tool parts each have at least one further bearing, which bearings attach die and punch to the upper tool part or lower tool part without play in the bearing plane.

If the two tool parts each have at least one further bearing, which bearings attach die and punch without play in the bearing plane, die and punch can be fixed in place on the respective tool part in comparatively simple manner, in terms of design, in the manner of a fixed/floating bearing, wherein thermal expansion/contraction of die and punch can nevertheless be reliably absorbed by the mounting. Furthermore, in this way the reciprocal orientation of die and punch can advantageously be maintained in spite of thermal expansion/contraction of the die or the punch, by way of these fixed locations, thereby making it possible to ensure precise and stable positioning of die and punch relative to one another. In contrast to the state of the art, provision of centering guides between die and punch, which guides have a complicated design, is therefore not necessary to guarantee shape-precise production using the forming tool. Therefore, a forming tool that is not sensitive to thermal expansion/contraction can be created with the solution according to the invention, which is comparatively simple in terms of design, with which tool reproducibly precise semifinished products or end products can be formed, for example deep-drawn, from a metal sheet. Preferably, the two tool parts can each have only one such bearing that is free of play in the bearing plane. In this way, for example, the design demands on the tool can be kept low.

In general, it should be mentioned that forming can be understood to be forming of sheet metal, for example pressure forming or tensile pressure forming. In particular, the forming tool in question can also be a deep-drawing tool.

If the bearing axes of the bearings that run normal to their bearing plane lie on a common straight line when the forming tool is closed, the reciprocal orientation of die and punch with regard to thermal expansion/contraction can be maintained more robustly. This is because the two aligned bearing axes force die and punch to permit thermal changes in their geometrical dimensions exclusively about their common fixed position in the closed tool, thereby making it possible to constantly ensure precise and stable positioning of die and punch relative to one another. A forming tool that is extremely non-sensitive to thermal expansion/contraction can thereby be created, which tool can reproducibly ensure the production of shape-precise semifinished products or end products.

Precise and stable positioning of die and punch relative to one another can be maintained even in cases of elevated thermal expansion/contraction, if the common straight line runs through the center of gravity of die and punch when the forming tool is closed. This design regulation is therefore not oriented based on the center of gravity of the die and the center of gravity of the punch, which two centers of gravity generally do not align when the forming tool is closed, but rather based on the center of gravity of the two masses when the forming tool is closed.

In this way, thermal expansion/contraction of die and punch, which might be different, can be coordinated with one another and equalized—and this can further increase the reproducibility of the forming tool.

Simple design conditions can occur if the bearing is disposed in the center of die or punch.

If the bearing forms a fixed clamping device, the reciprocal orientation of die and punch can be further increased, in terms of its robustness with regard to thermal expansion/contraction.

Such a fixed clamping device can be formed, for example, by means of a fixed connection—for example in the form of a clamping pin or centering bolt. Furthermore, these fixed connections can contribute to centering of the die or of the punch, and thereby facilitate assembly of the forming tool or also its maintenance. Furthermore, a clamping pin can carry away comparatively high shear forces, and this can further increase the stability of the forming tool with regard to thermal expansion/contraction.

If the floating bearings each have a screw connection with bearing play, a simple solution, in terms of design, can occur, in order to produce freedom of movement at the floating bearing. By means of radial bearing play, in particular, any type of thermal expansion/contraction of the die or punch can be compensated—independent of direction—and as a consequence, this can increase the robustness of the forming tool.

Bearing play at the screw connection can be made possible, with a simple design, if the attachment screw of the screw connection passes through an opening in the upper tool part or lower tool part with bearing play.

If the attachment screw is structured as an expansion screw, the thermal expansion/contraction that can be equalized by the floating bearing can be increased beyond the dimension of the bearing play by means of the expandability of the attachment screw. This can further increase the stability of the forming tool.

The energy efficiency of the forming tool can be increased if heat insulation is provided between die and upper tool part and/or punch and lower tool part, in each instance. In this regard, pressure-resistant insulation, in particular, can have a supportive influence on the dimensional precision of forming, by means of position stabilization of die and punch.

If the die and/or the punch are laterally enclosed by heat insulation, this can further reduce the energy loss of the forming tool and thereby additionally increase the energy efficiency.

If the forming tool has a closable housing, which encloses punch and die, this can further contain the energy loss of the forming tool. In particular, the temperature loss of die and punch if the housing is briefly opened can be minimized.

In order to be able to temper punch and/or die, it can be provided that the forming tool has a tempering device for cooling and/or heating the die and/or the punch.

Different tempering of die and/or punch, by way of the tool surface, can be achieved if die or punch have formed bodies that are heat-insulated from one another.

A comparatively great temperature gradient, advantageous for increased degrees of forming, can be achieved if a formed body tempered by the tempering device borders on a non-tempered formed body.

If the tempering device has at least one line that runs within die and/or punch to cool or heat them, tempering of the tools can be improved, for example accelerated or better coordinated with one another.

Figure 2:
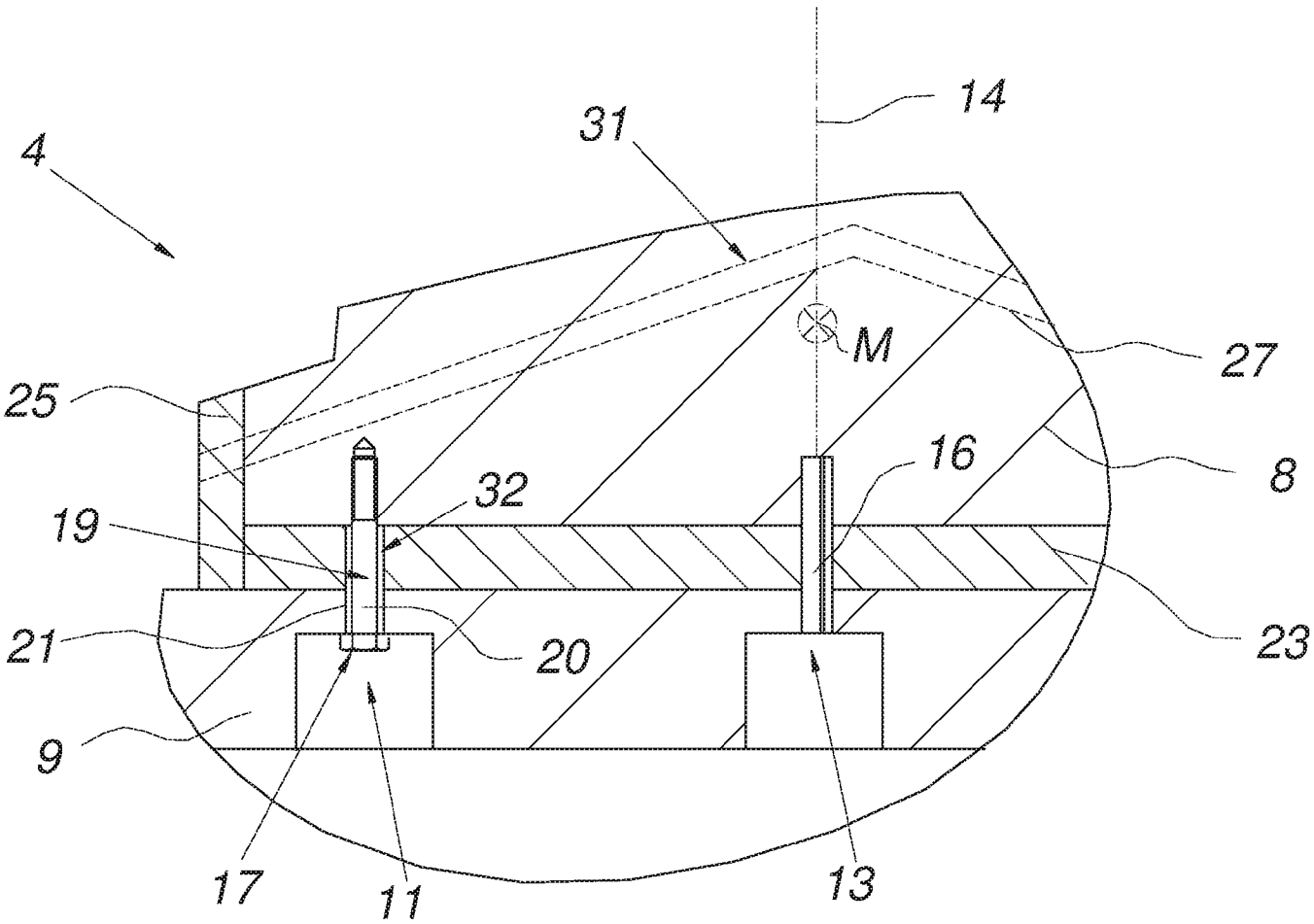

In the figures, the object of the invention is shown in greater detail as an example, using an embodiment variant. The figures show:

FIG. 1 a partially torn-open side view of a forming tool,

FIG. 2 a tear-away enlarged detail of FIG. 1, and

Figure 3:
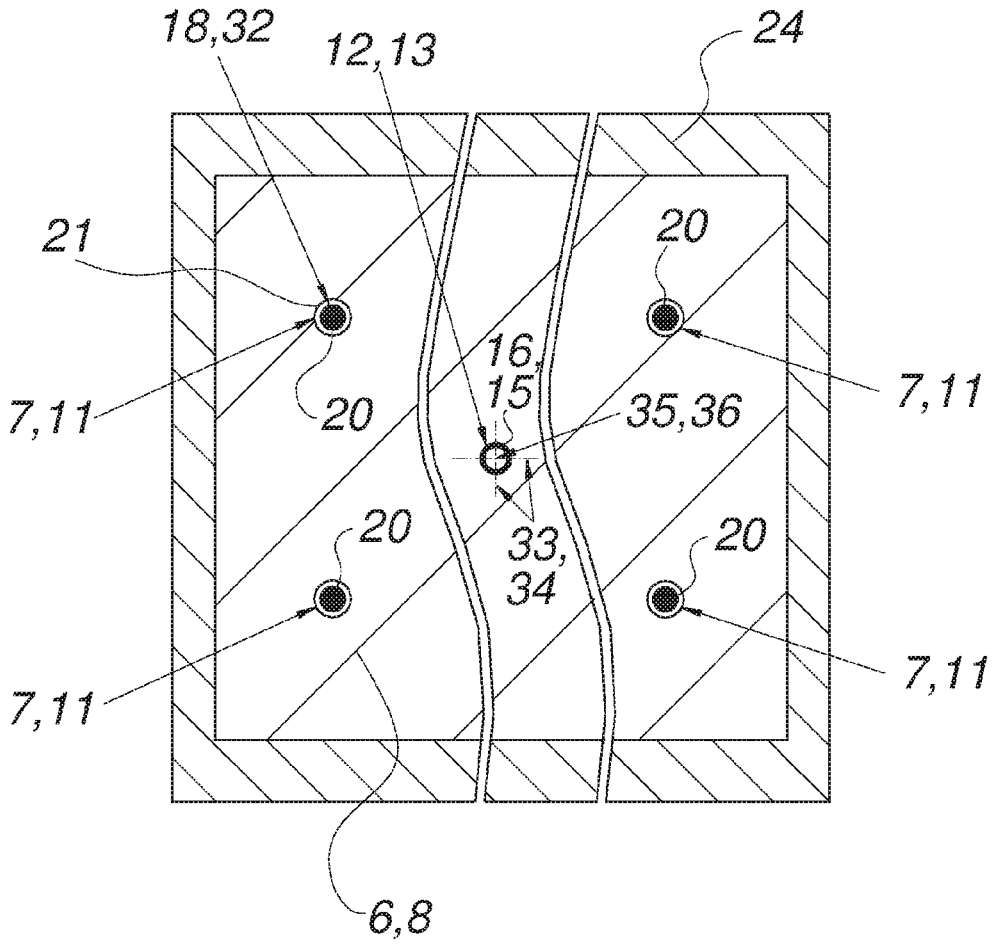

FIG. 3 a torn-open top view of a section through die and punch of the forming tool according to FIG. 1.

According to FIG. 1, for example, a forming tool 1 for the production of a semifinished product or end product from a metal sheet 2, for example having a cubic surface-centered crystal lattice, is shown. The metal sheet 2 can preferably be a sheet composed of an aluminum alloy. The forming tool 1 consists essentially of a first tool part 3 and a second tool part 4, wherein the first tool part 3 can be moved toward and away from the latter, in order to close and open the forming tool 1, respectively. As can further be derived from FIG. 1, the first tool part 3 has an upper tool part 5, to which a die 6 is attached—specifically by way of multiple first floating bearings 7. The same method of attachment can also be found in the second tool part 4, between punch 8 and lower tool part 9. Here, the punch 8 is attached to a lower tool part 9 by way of multiple second floating bearings 11.

Furthermore, the forming tool 1 has a tempering device 31 for cooling of the die 6 and of the punch 8. This tempering device 31 cool these with liquid nitrogen, which takes place, for example—although this is not shown—by spraying the nitrogen on. This leads to thermal contraction of die 6 and punch 8, which are accommodated in stable manner by the floating bearings 7, 11 between die 6 or punch 8 and the upper tool part 5 or lower tool part 9, respectively. For this purpose, the floating bearing 7, 11 attach the die 6 or the punch 8 to the upper tool part 5 or lower tool part 9, respectively, with bearing play 18 or 32, in the bearing plane 33 or 34, respectively. It is also conceivable that the tempering device 31 heats die 6 and punch 8, and thereby it would hold true, accordingly, that thermal expansion of die 6 and punch 8 is compensated by the floating bearings 7, 11.

Because the die 6 of the first tool part 3 works together with the punch 8 of the second tool part 4 for forming of the metal sheet 2, comparatively precise relative orientation of them is required for the production of a shape-precise semifinished product or end product. However, floating mounting of die 6 and punch 8 cannot ensure such a required orientation.

Precise positioning of die 6 and punch 8 relative to one another is created, with a simple design, in that the two tool parts 3, 4 each have at least one further bearing 12, 13. These bearings 12, 13 act parallel to their respective floating bearings 7, 11 and mount either the die 6 on the upper tool part 5 or the punch 8 on the lower tool part 9, free of play in the bearing plane 33, 34—so that in this way, a type of fixed/floating mounting is formed, and this represents a particularly stable mounting with regard to thermal expansion/contraction.

Mounting of die 6 and punch 8 according to the invention is furthermore particularly characterized in that the bearing axes 33, 34 of the bearings 12, 13 that run parallel to their bearing plane 33, 34 lie on a common straight line 14 when the forming tool 1 is closed—as this line is shown with a broken line in FIG. 1. In this way, precise orientation of die 6 and punch 8 can be maintained even in the case of their thermal expansion/contraction, and this always ensures a metal sheet 2 that is formed with shape precision.

As can be recognized in FIG. 1 and 2 when looking at them together with FIG. 3, the common straight line 14 runs through the center of gravity M of die 6 and punch 8 when the forming tool 1 is closed. In this way, the thermal expansion/contraction is coordinated with the closed tool state, and this significantly increases the robustness of the forming tool 1 with regard to thermal stresses. Furthermore, it can be derived from the FIGS. that the first bearing 12 is disposed in the center of the die 6 and the second bearing 13 is disposed in the center of the punch 8.

Production tolerances of the bearings 12, 13 are equalized by means of the use of a clamping pin 15, 16, in each instance, and this furthermore gives the bearings 12, 13 great shear strength. Furthermore, in this way firm clamping can be created with a simple design, in order to thereby fix die 6 and punch 8 in place on the related upper tool part 5 or lower tool part 9.

The floating bearings 7 and 11 on the tool parts 3 and 4 have screw connections 17 with radial bearing play 18, 32, as is shown in FIG. 2, as an example, using the floating bearing 11, or in FIG. 3. The radial bearing play 32 of the floating bearing 11 is formed by an opening 21 in the lower tool part 9 that is greater as compared with the screw neck 19 of an attachment screw 20, which attachment screw 20 passes through the opening 21. On the basis of the dimension of the bearing play 32, the thermal contraction can be carried away by the floating bearing 11—wherein in the event that this bearing play 32 is exceeded, the attachment screw 20, which is structured as an expansion screw, permits expansion, in order to be able to continue to withstand the thermal contraction without breaking. The same design embodiment of the floating bearing 11 according to FIG. 2 can also be recognized in accordance with FIG. 3 for the floating bearing 7.

As can furthermore be seen in FIG. 1, the tempered die 6 and the tempered punch 8 are heat-insulated, in that a pressure-resistant heat insulation 22, 23 is provided between die 6 or punch 8 and upper tool part 5 or lower tool part 9, respectively, in each instance. Furthermore, not only is die 6 enclosed laterally by a heat insulation 24, but also punch 8 is enclosed laterally by a heat insulation 25, in each instance.

The tempering device 31 has lines 26, 27 for conducting the liquid nitrogen—wherein the line 26 runs within the die 6 and line 27 within the punch 8. It is also conceivable to use the lines for conducting an oil instead of the nitrogen, in order to thereby heat die 6 and punch 8. Instead of the oil or of the lines, electric heating is also conceivable, but this has not been shown in any detail.

In order to partially eliminate tempering or cooling of the punch 8, the punch 8 is divided into two formed bodies 28 and 29, which are thermally separated from one another by a heat insulation 30. In this way, an actively cooled formed body 28 and a non-cooled formed body 29 can be provided next to one another—these therefore border on one another, in order to thereby allow great degrees of forming of the metal sheet 2, for example.

Furthermore, the forming tool has a closable housing—among other things to improve the energy efficiency—which encloses punch 8 and die 6 and has not been shown in any detail.

The invention claimed is:

1. Forming tool for the production of a semifinished product or end product from a metal sheet, having a first tool part that has an upper tool part, a die, and at least one first floating bearing, which attaches the die to the upper tool part with bearing play in the bearing plane, for equalization of its thermal contraction or expansion, having a second tool part that has a lower tool part, a punch, and at least one second floating bearing, which attaches the punch to the lower tool part with bearing play in the bearing plane, for equalization of its thermal contraction or expansion, wherein the punch and the die work together for forming of the metal sheet, and wherein the two tool parts each have at least one further bearing, which bearings attach the die and the punch to the upper tool part or the lower tool part without play in the bearing plane.

2. Forming tool according to claim 1, wherein bearing axes of the at least one further bearings run normal to their bearing plane and lie on a common straight line when the forming tool is closed.

3. Forming tool according to claim 2, wherein the common straight line runs through the center of gravity of the die and the punch when the forming tool is closed.

4. Forming tool according to claim 1, wherein the at least one further bearing is disposed in the center of the die or the punch.

5. Forming tool according to claim 1, wherein the at least one further bearing forms a fixed clamping device.

6. Forming tool according to claim 5, wherein the at least one further bearing has a clamping pin or a centering bolt.

7. Forming tool according to claim 1, wherein the floating bearings each have a screw connection having a bearing play.

8. Forming tool according to claim 7, wherein an attachment screw of the screw connection passes through an opening in the upper tool part or in the lower tool part with bearing play.

9. Forming tool according to claim 8, wherein the attachment screw is structured as an expansion screw.

10. Forming tool according to claim 7, wherein the bearing play of the screw connections is a radial bearing play.

11. Forming tool according to claim 1, wherein a heat insulation is provided between the die and the upper tool part and/or the punch and the lower tool part, in each instance.

12. Forming tool according to claim 11, wherein the heat insulation is a pressure-resistant heat insulation.

13. Forming tool according to claim 1, wherein the forming tool has a closable housing that encloses the punch and the die.

14. Forming tool according to claim 1, wherein the die and/or the punch are laterally enclosed by a heat insulation.

15. Forming tool according to claim 1, wherein the forming tool has a tempering device for cooling and/or heating of the die and/or of the punch.

16. Forming tool according to claim 15, wherein the tempering device has at least one line that runs within the die and/or the punch, for cooling or heating them.

17. Forming tool according to claim 1, wherein the die or the punch have formed bodies that are heat-insulated from one another.

18. Forming tool according to claim 17, wherein a formed body tempered by the tempering device borders on a non-tempered formed body.

* * * * *